US006450737B1

(12) United States Patent
Rytand et al.

(10) Patent No.: US 6,450,737 B1
(45) Date of Patent: Sep. 17, 2002

(54) FLOATING CONCRETE DOCK SECTIONS AND METHODS FOR MAKING THE SAME

(75) Inventors: David H. Rytand, 12142 Salty La., Anacortes, WA (US) 98221; Kelly D. LaFave, Anacortes, WA (US)

(73) Assignee: David H. Rytand, Anacortes, WA (US)

( * ) Notice: Subject to any disclaimer, the term of this patent is extended or adjusted under 35 U.S.C. 154(b) by 0 days.

(21) Appl. No.: 09/731,298

(22) Filed: Dec. 5, 2000

(51) Int. Cl.[7] ..... B63B 35/38

(52) U.S. Cl. ..... 405/219; 405/218; 405/220; 114/266; 114/267

(58) Field of Search ..... 405/218, 219, 405/220, 221; 114/264, 266, 267; 14/2.6, 27

(56) References Cited

U.S. PATENT DOCUMENTS

| | | | | |
|---|---|---|---|---|
| 3,967,569 A | | 7/1976 | Shorter, Jr. | |
| 4,070,980 A | * | 1/1978 | Shorter, Jr. | 114/263 |
| 4,318,362 A | * | 3/1982 | Jung | 114/263 |
| 4,365,577 A | * | 12/1982 | Heinrich | 114/267 |
| 4,365,914 A | | 12/1982 | Sluys | |
| 4,453,488 A | | 6/1984 | Watchorn | |
| 4,559,891 A | * | 12/1985 | Shorter, Jr. | 114/263 |
| 4,709,647 A | * | 12/1987 | Rytand | 114/263 |
| 4,887,654 A | * | 12/1989 | Rytand | 114/263 |
| 4,940,021 A | | 7/1990 | Rytand | |
| 5,050,524 A | | 9/1991 | Kyhl et al. | |
| 5,297,899 A | | 3/1994 | Culley | |
| 5,347,948 A | | 9/1994 | Rytand | |
| 5,421,282 A | * | 6/1995 | Morris | 114/264 |
| 5,529,012 A | | 6/1996 | Rytand | |
| 5,740,753 A | | 4/1998 | Theophanis | |
| 5,950,558 A | | 9/1999 | Strong | |

OTHER PUBLICATIONS www.dogpile.com search page "concrete dock floating", 3 pages.* www.shoremaster.com webpage on concrete floating dock Model 850, 2 pages, www.mfgnet.org/preview/shoremaster/html/model_850.htm.*

Waterfront Development—International Marine Floatation Systems, Inc., "Marinas, Docks and Wave Attenuators", pp. 2, http://www.floatinghomes.com/marinas.html, (Mar. 2000).

* cited by examiner

*Primary Examiner*—David Bagnell
*Assistant Examiner*—Katherine Mitchell
(74) *Attorney, Agent, or Firm*—Klarquist Sparkman, LLP

(57) ABSTRACT

A floating dock assembly comprising a plurality of interconnected concrete float sections is disclosed. Each float section comprises a concrete shell having a deck portion, opposing side walls, opposing end walls, and an open bottom which together define a flotation container. A self-centering flotation core is disposed in the flotation container and has a bottom portion that extends outside thereof to increase the freeboard of the float section. The concrete shell further includes a pair of opposing, horizontally projecting concrete structural side flanges extending along the length of each side wall and a pair of opposing, horizontally projecting concrete end flanges extending along the length of each end wall. Each flange is of sufficient thickness to permit direct attachment of mooring accessories and dock hinges for interconnecting adjacent float sections without additional structural components such as conventional timber wales.

35 Claims, 5 Drawing Sheets

FLOATING CONCRETE DOCK SECTIONS AND METHODS FOR MAKING THE SAME

FIELD OF THE INVENTION

This invention relates generally to concrete floating docks and methods for making the same.

BACKGROUND OF THE INVENTION

Floating dock structures are widely used in marinas and boat harbors as a means for docking and mooring water craft in tidal waters or in other bodies of water subject to changing water level. Typically, floating docks structures are constructed by interconnecting individual or modular float sections. A common arrangement for a floating dock includes a central walkway comprised of float sections connected end-to-end and a series of dock sections projecting perpendicularly from the walkway so as to form a series of boat slips.

Individual float sections are commonly formed by completely or partially encasing a buoyant flotation core, such as polystyrene, in a concrete shell. Over time, traditional concrete float sections have shown their inability to consistently resist the environmental conditions and dynamic forces acting upon them without damage. Traditional concrete floats have also shown their inability to consistently float with adequate freeboard without listing or relative twisting between dock sections. Maximizing freeboard is necessary to ensure that the dock components comprising material susceptible to corrosion and deterioration, such as steel or wood, generally reside above the splash zone of the dock.

Generally, the design of concrete docks is influenced by three factors: (1) the limitations of lightweight aggregate-based concrete and thin concrete sections; (2) the limitations of the strength, flexibility and compatibility of the connections linking dock sections; and (3) the complexity of manufacturing dock sections. The shortcomings of traditional concrete docks are further described with respect to these factors as follows.

Limitations of Lightweight Concrete and Thin Concrete Sections

Prior art concrete floats utilize thin concrete sections or lightweight aggregate-based concrete to minimize dead weight and thereby increase freeboard. Some float systems utilize both thin sections and lightweight concrete simultaneously.

Lightweight aggregate-based concrete, however, is generally not a preferred material for float sections because of its weak structural properties and porous nature. Thin concrete wall sections are also deficient in that they do not provide sufficient coverage for the embedded steel reinforcing which is susceptible to corrosion when placed in seawater. Corrosion of the steel reinforcing reduces the overall strength of the float and expands and spalls the concrete, further weakening the float and exposing the reinforcing to the elements, which in turn causes additional corrosion.

Floats made from lightweight concrete or with thin wall concrete sections are also vulnerable to freeze-thaw deterioration. This phenomenon occurs when water enters voids in the concrete via superficial cracks and expands upon freezing, thereby enlarging the cracks and spalling the concrete. Enlarged cracks and spalling allow additional water to penetrate the concrete, leading to yet larger cracks and more spalling. In a relatively short time, concrete surfaces can become so damaged by freeze-thaw deterioration that the entire float module must be replaced. The effects of freeze-thaw deterioration are even more destructive in floats made from lightweight concrete because the porous nature of such floats facilitates the absorption of water.

Since it is desirable to cast a concrete float that is both lightweight (to increase freeboard) and durable, it is necessary to increase the thickness of the concrete shell where it is most needed while eliminating other concrete sections to compensate for the added weight. For example, the durability of the protective concrete shell can be improved without increasing weight by eliminating the concrete bottom of the float, which is not required for structural support, so that the thickness of the side walls and deck may be increased. In such a configuration, the exposed portion of the flotation core is typically covered with a protective coating such as polyurethane.

Thicker concrete sections can also be achieved by eliminating redundant end walls in a series of dock sections coupled end-to-end. Conventional floats are typically cast in lengths of 8 to 12 feet. In contrast, monolithic concrete floats can be cast up to 60 feet in length. By increasing the overall length of the individual dock sections, the number of dock sections and thereby the number of end walls adding weight to the dock assembly is reduced. Removing weight in the form of end walls therefore allows for thicker concrete walls and decks.

Limitations of the Strength, Flexibility and Compatibility of Dock Module Connectors Concrete float sections are customarily connected to each other by elongated, rigid timber members, or wales, that extend along the upper side edges of the floats. The wales are typically fastened to the floats by tie rods extending transversely through the float and projecting through the wales. The ends of the rods are threaded to receive conventional nuts and washers which are torqued against the wales to compress the wales against the float. Alternatively, U.S. Pat. No. 3,967,569 to Shorter, Jr. (Shorter) discloses float units having horizontally projecting structural flanges that extend along the length of each side wall. The float units are interconnected end-to-end with wooden wales placed on the bottom and top surfaces of the structural flanges and bolted vertically therethrough. Each wale is underlain with a thin steel strap for additional structural strength.

When set in motion by wind or wave action, the heavy mass of traditional concrete floats causes flexing of the wooden wales which in turn, transmits substantial forces to the bolts or tie rods that fasten the wales to the floats. This leads to excessive wear or fatigue of the metal fasteners and as a result, adjacent float modules will eventually come in contact with each other and gradually beat themselves apart. It is difficult to keep the tie rods or bolts sufficiently tight so as to prevent movement of the wales relative to the float units because of the moisture incompatibilities of the wood-steel-concrete connection materials. Once bolt slip or compression of the wood occurs, the holes in the wales enlarge and allow for additional movement of float units, causing failure of the metal fasteners and contact between the concrete surfaces of adjacent floats, which in turn, causes wear and breakage of those surfaces. Further, bolt slip and wood compression causes the fasteners to work loose in the concrete, occasionally pulling out of the float.

Dock attachments, such as cleats and utility stands, are usually bolted directly to the wales because the concrete sections are too thin to accept bolts and are prone to cracking. Attachments subjected to substantial forces, such as mooring cleats, cannot develop their rated capacity because attachment strength is limited by the relatively thin timber members. In addition, to prevent damage to vessels using the dock, connections made with tie rods must not protrude past the mooring face of the float and therefore must be recessed within the side of the wale, which further weakens the connection.

Timber wales are also not capable of resisting the torsional twisting or listing of the assembled float units. The relative twisting between float units is partly due to the inconsistent structural properties of the different materials comprising the float connections and the high water absorption characteristics of the wooden wales. Over time, as the wales continue to creep and the float units become unevenly saturated, the twisting and listing of the float system becomes worse. Twisting and listing of floats is unsightly and is a safety concern in wet or icy conditions.

Flexible joints or hinges are typically used to couple longer, monolithic floats because the flexure forces, concentrated at the joints between float units, would quickly overpower a traditional timber wale-style, rigid connection. One such hinge comprises a steel bolt or cable surrounded by a rubber bushing secured at each end to a float section. This type of connection dissipates bending stresses between float sections but it is also susceptible to wear, fatigue and shock loading.

Float Unit Manufacture

Quality control of concrete float units is a particular problem associated with the float manufacturing process as manufacturers historically have had problems achieving consistent, balanced flotation. Because a concrete float module is top-heavy and individually unstable, a small variance in concrete wall thickness will lead to undesirable twisting and listing of the assembled float system. Variations in wall thickness are caused by shifting of the flotation core during the casting process. The tendency of the flotation core to shift off-center is often the result of unbalanced hydrostatic pressures created while the concrete is poured and the vibrating mechanism used to settle the concrete. During the manufacturing process, and especially once a float unit has been cast, it is very difficult to determine whether or not the flotation core has shifted. Thus, uneven wall thickness caused by the shifting effect of the core is not apparent until the float has been placed in water.

Moreover, manufacturers often increase the depth of a float unit in order to improve its freeboard. As a float is made deeper, however, it also becomes more unstable so the effects of flotation core shifting become more pronounced.

In addition to flotation problems, shifting of the flotation core reduces the thickness of at least one side wall and/or end wall of the concrete shell, thereby increasing the likelihood of corrosion of the embedded steel and the susceptibility to freeze-thaw damage.

SUMMARY OF THE INVENTION

The present invention seeks to overcome the foregoing problems of the prior art by providing an improved concrete floating dock assembly and a method for manufacturing individual float sections. A primary objective of the present invention is to furnish concrete float sections with increased strength and durability that float with adequate freeboard and minimal twisting or listing.

The invention accomplishes this objective with a dock assembly that includes a plurality of interconnected concrete float sections. Each float section comprises a reinforced concrete shell having a deck portion, a pair of opposing longitudinal side walls, a pair of opposing transverse end walls, and an open bottom which together define a flotation container. A flotation core is disposed in the flotation container and has a bottom portion that extends outside thereof.

The concrete shell further includes a pair of opposing, horizontally projecting concrete structural side flanges integral with and extending along the length of each side wall. Similarly, a pair of opposing, horizontally projecting concrete structural end flanges are integral with and extend along the length of each end wall.

By increasing the depth of the flotation core beyond that of the concrete shell, freeboard may be increased without reducing the weight of the float or increasing the depth of the concrete shell. Since the dead weight of the float section is not so limited by freeboard considerations as in prior art float sections, the thickness of the concrete sections comprising the shell may be increased to add strength and durability. Thus, the side flanges and end flanges are of sufficient thickness to permit direct attachment of mooring accessories and dock hinges for interconnecting adjacent float sections. Because attachment strength is not limited by the thickness of the flanges or by the use of wooden wales, each bolt in a dock attachment is capable of developing its full rated capacity. In addition, the use of side flanges and end flanges for the attachment of mooring accessories allows for their easy installation, removal or relocation after the dock assembly has been installed. Further, the increased concrete thickness of the side walls, end walls, and deck portion of the concrete shell reduces its susceptibility to corrosion and freeze-thaw deterioration.

The manufacturing process employed in the invention significantly reduces undesirable twisting and listing of each float section within the dock assembly. To fabricate a float section, a polyurethane coating is applied to the bottom surface of a flotation core which is then placed within a formwork having the shape and size of the concrete shell. Reinforcing bars are then secured in place between the formwork and the flotation core. The flotation core is configured to be self-centering such that each bottom side surface of the flotation core abuts against the inside surface of an adjacent formwork wall. After the flotation core and reinforcing bars are set in place, concrete is poured into the formwork around the sides and top of the flotation core to form the concrete shell. A vibrating mechanism may be employed to facilitate consolidation of the concrete. After the concrete has hardened, the formwork is stripped away.

By having the flotation core in contact with the sides and bottom of the formwork, it remains centered and cannot shift laterally or float upwards regardless of vibration or unbalanced hydrostatic pressures. The flotation core ensures consistent concrete thickness in the side walls, end walls, and deck portion of the concrete shell so that twisting and listing of the float section due to flotation core shifting and uneven wall thickness is eliminated.

The foregoing and other objects, features and advantages of the present invention, as well as additional embodiments thereof, are described further in the following detailed description, which proceeds with reference to the accompanying drawings.

DETAILED DESCRIPTION OF THE PREFERRED EMBODIMENTS

Figure 1:
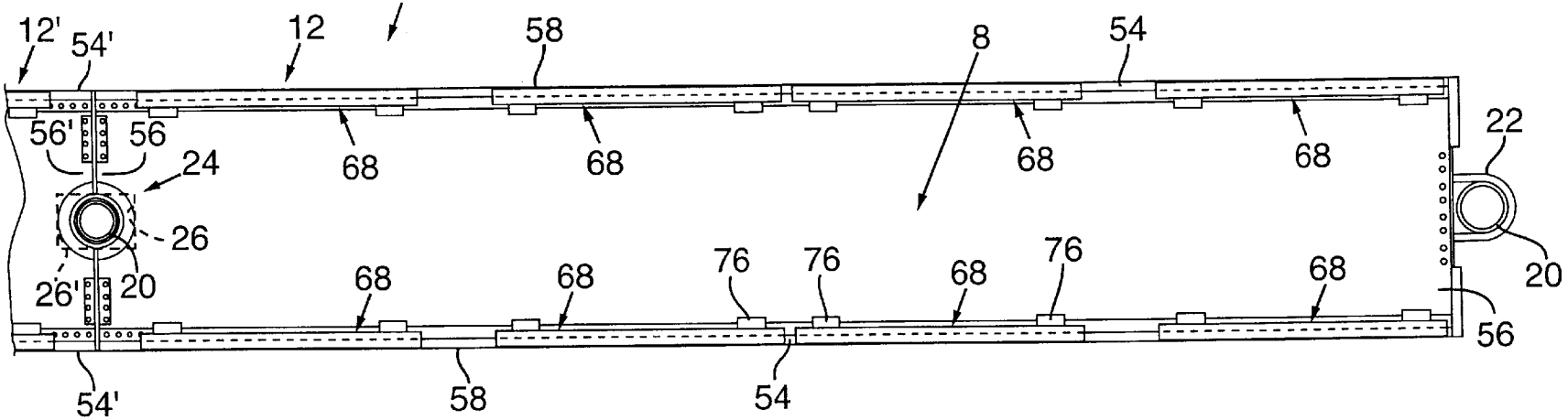
FIG. 1 is a top view, partially broken away, of a floating dock assembly embodying the present invention.
Figure 2:
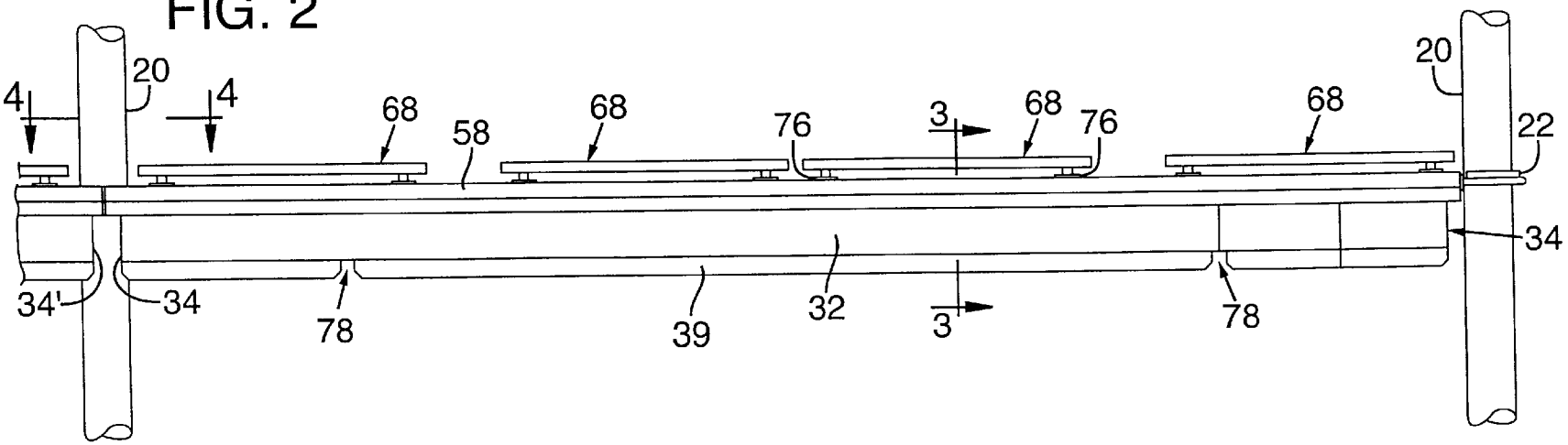
FIG. 2 is a side view of the dock assembly of FIG. 1.
Figure 7:
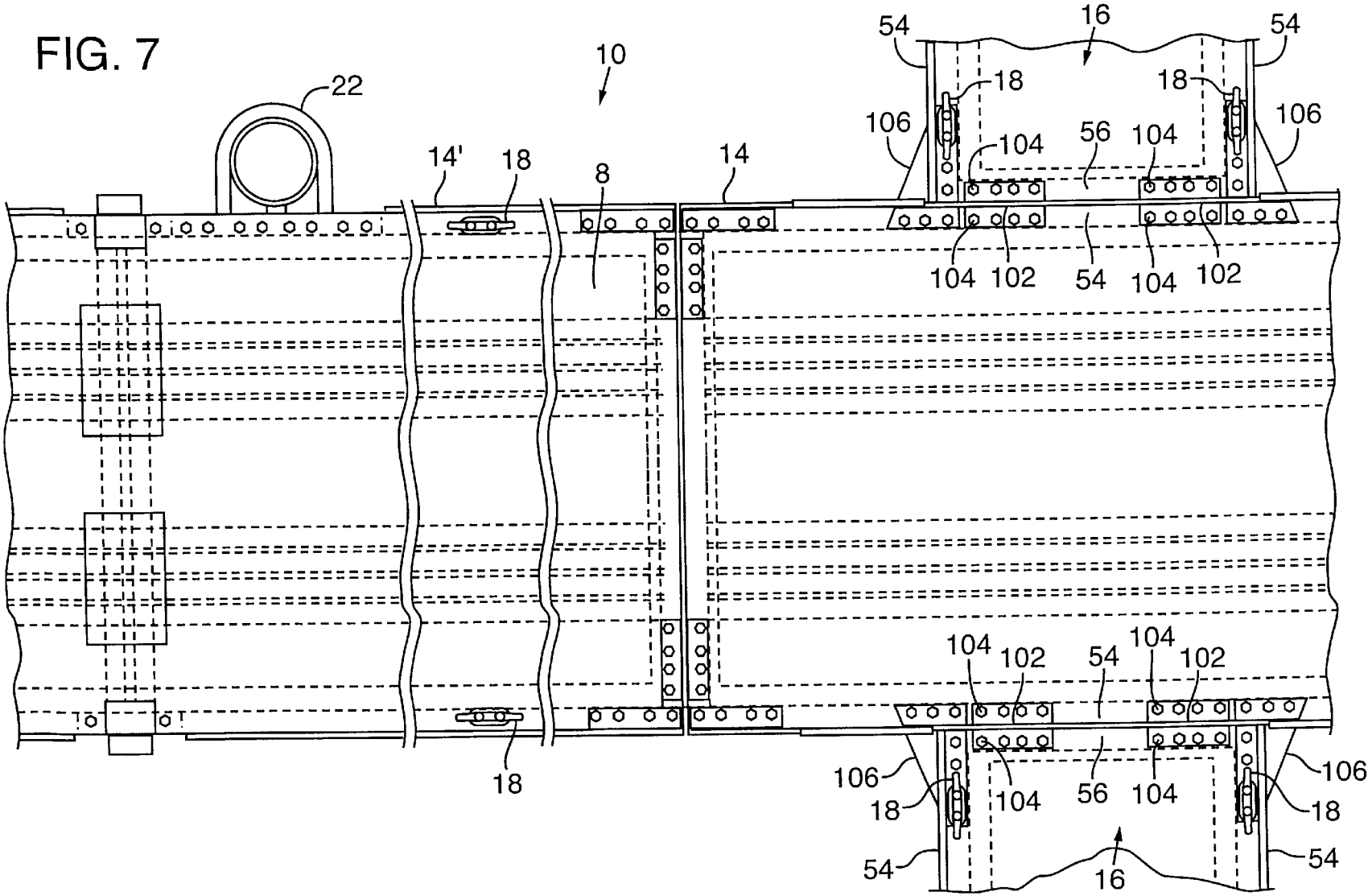
FIG. 7 is a top view, partially broken away, of a dock assembly embodying the present invention and comprising dock sections placed end-to-end and in perpendicular relation to each other.

Referring FIGS. 1 and 2, there is shown a section of a floating dock assembly 10 embodying the present invention. The dock assembly 10 includes a pair of elongated, monolithic concrete float units or sections, 12, 12' coupled end-to-end, forming a main walkway 8. Additional float sections may be similarly coupled lengthwise to increase the length of the main walkway 8. As shown in FIG. 7, another section of the dock assembly 10 includes a pair of float sections 14, 14' coupled end-to-end and finger float sections 16 projecting perpendicularly from float section 14 so as to form a series of boat slips. Boats are moored in a conventional manner along side the dock assembly 10 with mooring cleats 18 and bullrails 68, as discussed below. As discussed in detail below, adjacent float sections are coupled via flexible hinges, rather than conventional timber wales.

Typically, each float section of the main walkway 8 is 48 feet long, 12 feet in width, and 3 feet deep. A finger float section 16 is typically 50 feet long, 6 feet in width, and 3 feet deep. Accordingly, each float section is long enough to replace several interconnected, smaller float sections without the use of timber wales for structural support. The finger float sections 16 in particular are each long enough to replace numerous interconnected smaller float sections typically used to comprise a finger float assembly in a dock made up of such float sections. In this sense, the float sections of the present invention may be referred to as being "monolithic."

The dock assembly 10 is preferably anchored with stationary pilings 20. As shown in FIG. 2, one piling 20 extends vertically through a conventional steel pile hoop 22 that is mounted to the free end of float section 12. The inside surface of the pile hoop 22 is preferably lined with a low friction material such as polyethylene for engaging the surface of the piling 20. Another piling 20 extends vertically through an internal steel pile hoop 24 disposed between adjacent ends of the float sections 12, 12'. The internal pile hoop 24, which is also preferably lined with a low friction material such as polyethylene, is fitted into two notches 26, 26' recessed into the adjacent ends of the float sections 12, 12', respectively. The pilings 20, which are anchored in the seabed, restrict the lateral movement of the float sections while allowing them to rise and fall with the tide. Alternatively, the dock assembly 10 may be anchored by other conventional means such as a mooring configuration employing lines or chains that tie off the dock assembly to concrete anchors on the seabed.

Figure 3:
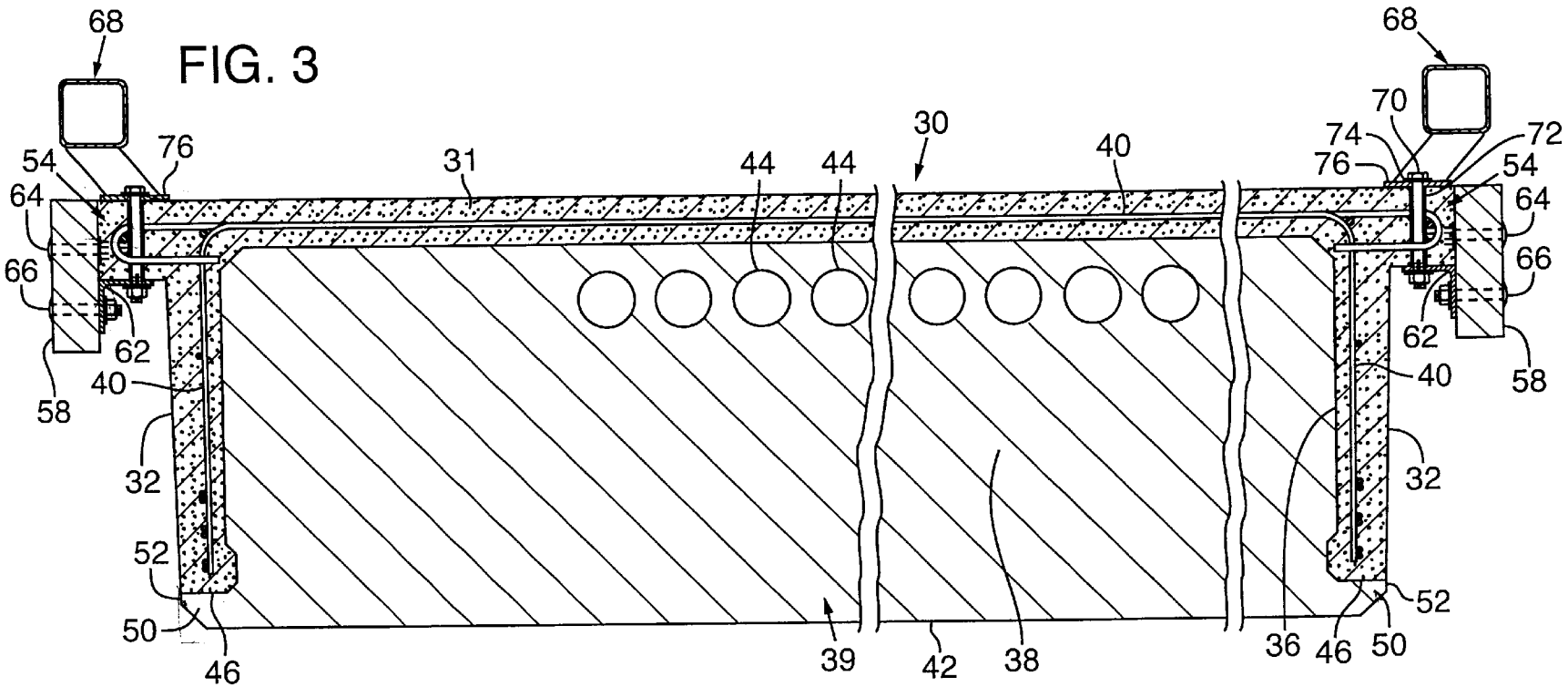
FIG. 3 is an enlarged cross-sectional view of a dock section taken along line 3—3 of FIG. 2.
Figure 6:
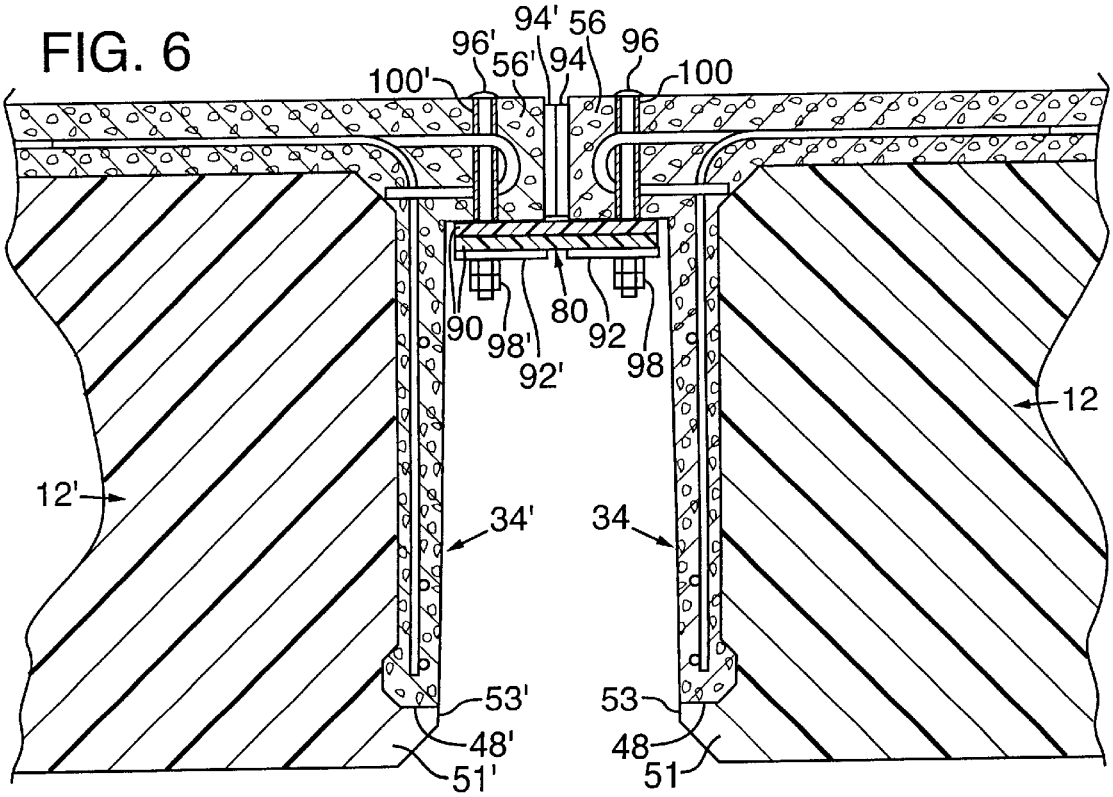
FIG. 6 is an enlarged, fragmentary cross-sectional view of the dock assembly taken along line 6—6 of FIG. 4.

As shown in FIG. 3, each float section 12, 12' comprises a concrete shell 30 having a deck portion 31, a pair of opposing longitudinal side walls 32, a pair of opposing transverse end walls 34 (as shown in FIGS. 2 and 6), and an open bottom which together define a flotation container 36. A flotation core 38, preferably comprising a polystyrene foam block, is disposed within the flotation container 36. Steel reinforcing bars ("re-bars") 40 are embedded within the concrete shell 30 for structural strength.

The depth of the flotation core 38 is greater than the depth of the side walls 32 and end walls 34 so that a bottom portion 39 of the flotation core 38 extends outside of the flotation container 36. The bottom portion 39 forms a pair of longitudinally extending projection ridges 50, each of which overlaps the bottom ledge 46 of an adjacent side wall 32. Each projection ridge 50 forms a vertically extending surface portion 52 that is aligned with the outside surface of an adjacent side wall 32. This feature is significant as will be explained below in the description of the manufacturing process of the float sections. As shown in FIG. 6, the bottom portion 39 similarly forms a pair of transverse projection ridges 51, each of which overlaps the bottom ledge 48 of an adjacent end wall 34. Each projection ridge 51 forms a vertically extending surface portion 53 that is aligned with the outside surface of an adjacent end wall 34.

The exposed surface of the bottom portion 39 is coated with a protective coating 42 (see FIG. 3), preferably a thin layer of polyurethane, to protect against degradation of the flotation core. As shown in FIG. 3, the flotation core 38 also includes a plurality of longitudinally extending utility chases 44 through which utility lines, such as electrical and telephone lines and water, can be inserted. As shown in FIG. 2, a pair of transverse lifting slots 78 are formed in the bottom portion 39 of the flotation core to receive lifting straps or forklift forks for moving the float section.

Referring again to FIG. 3, the concrete shell 30 may include a pair of opposing, horizontally projecting concrete structural side flanges 54 integral with and extending along the length of each side wall 32. Similarly, a pair of opposing, horizontally projecting concrete structural end flanges 56 are integral with and extend along the length of each end wall 34 (best shown in FIG. 6). The upper surface of each side flange 54 (FIG. 3) and end flange 56 (FIG. 6) preferably is planar to the upwardly facing surface of the deck portion 31 to form a substantially flat top surface. For reasons provided below, the side flanges and end flanges can be casted having sufficient thickness to permit direct attachment of mooring accessories and dock hinges for interconnecting adjacent float sections without additional structural components such as conventional timer wales.

For example, a series of spaced apart bullrails 68 are preferably mounted along the upper surface of each side flange 54 to provide a means for mooring boats (see FIG. 2). As shown in FIG. 3, each bullrail 68 includes a pair of support feet 76, each of which is fastened to the side flange 54 with a plurality of vertically extending bolts 70. A washer 74 is preferably positioned between the head of each bolt 70 and support foot 76. Each bolt 70 extends through a sleeve 72 that is cast into the side flange 54, and an L-shaped angle 62 that is securely mounted to the bottom surface of the side flange 54. The sleeves 72 are made from any suitable material, such as steel or plastic. In the alternative, holes may be drilled into the side flanges 54 for receiving bolts 70 without sleeves 72. Finally, each bolt 70 is secured with a conventional nut and washer disposed on its bottom end. The number of bolts 70 used for mounting each support foot 76 should be enough to provide sufficient redundancy in the connection. Because attachment strength is not limited by the thickness of the side flanges 54 or by the use of wooden wales, each bolt is capable of developing its fall rated capacity. Other mooring accessories, such as cleats, pile hoops, and utility stands, may be mounted in a similar manner at any point along the side flanges and end flanges of any float section within the dock assembly 10. For example, cleats 18 may be mounted to the side flanges 54 of finger float sections 16, as shown in FIG. 7. The use of side flanges 54 and end flanges 56 for the attachment of mooring accessories allows for their easy installation, removal or relocation after the dock assembly has been installed.

A rub board 58 covers the vertical face of each side flange 54 to provide a protective member against which moored boats may bump. Angles 62, which are about ½ of a foot in length, are spaced along the lower surface of each side flange 54 to provide support for the lower half of the rub boards 58. The rub boards 58 are secured to each side of the float section 12 with upper bolts 64, each of which is tightened into a threaded insert (not shown) that is cast in the side flange 54. The rub boards 58 are further secured with lower bolts 66, which extend through corresponding holes defined in angles 62 and are retained by a conventional washer and nut on their outer end. If the width of the rub board 58 is such that it does not extend past the lower surface of the side flange 54, then it may be secured to the side flange 54 without the use of lower bolts 66 or angles 62.

Figure 4:
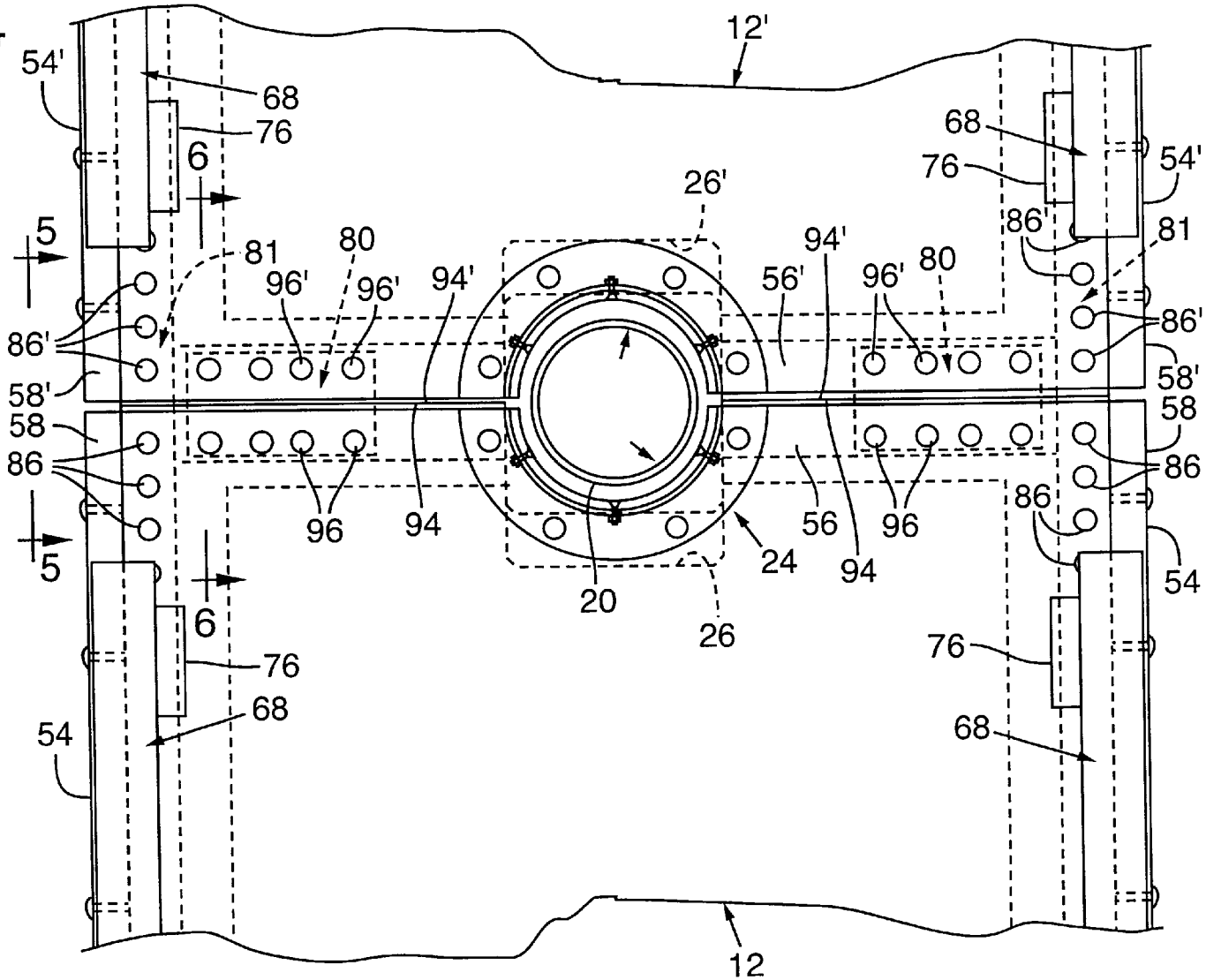
FIG. 4 is an enlarged, fragmentary top view of the dock assembly taken along line 4—4 of FIG. 2.

Referring now to FIG. 4, there is shown in phantom the placement of a plurality of semi-flexible dock hinges used to couple the adjacent ends of the float sections 12, 12'. More specifically, a pair of transverse semi-flexible dock hinges 80 interconnect end flanges 56, 56' of the adjacent ends of the float sections 12, 12'. The adjacent ends of the float sections 12, 12' are further coupled along opposing sides of the dock assembly 10 with a pair of opposing, longitudinal semi-flexible dock hinges 81, each of which interconnects a pair of aligned side flanges 54, 54'. In a typical dock assembly, the adjacent ends of the float sections 12, 12' are spaced apart approximately 1 inch from one another. Rubber joint filler 94, 94' is preferably positioned between end flanges 56, 56' to cushion the loads imposed on the face of each end flange by an adjacent float.

Figure 5:
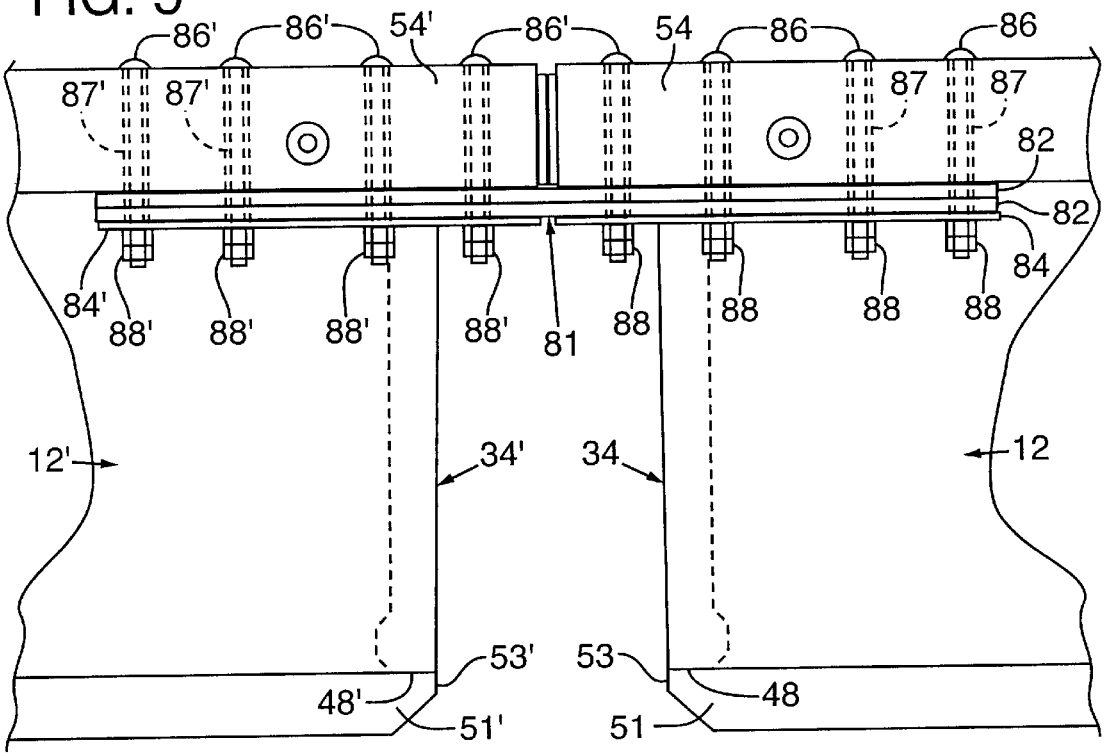
FIG. 5 is an enlarged, fragmentary side view of the dock assembly with the rub board removed to show the hinge interconnecting adjacent dock ends taken along line 5—5 of FIG. 4.

As shown in FIG. 5, each hinge 81 comprises one or more layers of belting material 82 and is secured to the lower surface of side flange 54 with bolts 86 and to the lower surface of side flange 54' with bolts 86'. Each bolt 86, 86' extends through a sleeve 87, 87', which facilitates installation and replacement of the bolt. Flat bars 84, 84' having holes therethrough for receiving bolts 86, 86' are preferably positioned between the bottom layer of belting material 82 and each pair of nuts 88, 88' disposed on the bottom ends of each bolt 86, 86'. The number of bolts 86, 86' used for securing the belting material 82 should be enough to provide sufficient redundancy in the connection. Again, each bolt is capable of developing its full rated capacity because attachment strength is not limited by the thickness of the side flanges 54, 54' or by the use of wooden wales.

As shown in FIG. 6, each hinge 80 similarly comprises one or more layers of belting material 90 and is secured to the lower surface of end flange 56 with bolts 96 and to the lower surface of end flange 56' with bolts 96'. Each bolt 96, 96' extends through a sleeve 100, 100'. Flat bars 92, 92' having holes therethrough for receiving bolts 96, 96' are preferably positioned between the bottom layer of belting material 90 and each pair of nuts 98, 98' disposed on the bottom ends of each bolt 96, 96'.

The belting material 82 and 90 used in hinges 81 and 80, respectively, are comprised of a corrosion-resistant material that is flexible enough to sufficiently pivot and twist to reduce the overall stress on the float sections 12, 12', and having strength enough so that it will not break under anticipated loads tending to separate the float sections 12, 12'. A suitable material for the belting material A2 and 90 is one inch thick PLYLON™ 1000, three-ply, fabric-carcassed rubber belting material manufactured by the Goodyear Tire and Rubber Company of Akron, Ohio. This material has sufficient flexibility to yield such that excessive stress and strain is not imposed on the attached float sections as they move relative to one another.

As shown in FIG. 7, finger float sections 16 are coupled in perpendicular relation to float section 14. A pair of semi-flexible hinges 102 couple the end flange 56 of each finger float section 16 with an adjacent side flange 54 of float section 14. Each hinge 102 comprises one or more layers of belting material (not shown) and is secured to the lower surface of the end flange 56 and to the lower surface of the side flange 54 with bolts 104. Additional semi-flexible comer hinges 106, preferably comprising two layers of belting material, are provided to limit relative pivoting movement of each finger float section 16. Each comer hinge 106 is secured at one end to the side flange 54 of the finger float section 16 and at the other end to the side flange 54 of float section 14.

To fabricate each float section, the flotation core 38 is first cut to its desired shape from a polystyrene block. Where the size of the flotation core 38 is greater than that of any commercially available blocks, it may be formed in sections of polystyrene cemented together. A coating of polyurethane may be applied to the surface of the bottom portion 39 of the flotation core 38 to protect against degradation of the flotation core 38.

Then, the flotation core is placed into a formwork having the shape and size of the concrete shell 30 and reinforcing bars 40 are set in place around the flotation core 38. When placed in the formwork, the flotation core 38 is configured to be self-centering such that each of the surface portions 52, 53 of the projecting ridges 50, 51 abut against the inside surface of an adjacent formwork wall.

After the flotation core has been set in place within the formwork, concrete is poured into the formwork around the sides and top of the flotation core to form the concrete shell 30. A vibrating mechanism may be employed to facilitate consolidation of the concrete. After the concrete has hardened, the formwork may be stripped away.

By having the surface portions 52, 53 and bottom surface 39 of the flotation core in contact with the formwork, the flotation core remains centered and cannot shift laterally or float upwards regardless of vibration or unbalanced hydrostatic pressures. The use of such a flotation core ensures consistent concrete thickness in the side walls, end walls, and deck portion of the concrete shell. Accordingly, the balance of each float section is substantially improved over the prior art because the twisting and listing of each float section due to flotation core shifting and uneven wall thickness is eliminated.

The present invention enjoys several additional advantages unknown in the prior art. As previously mentioned, freeboard in prior art float sections could only be gained by increasing the depth of the concrete shell or reducing the overall weight of each float section. In the present invention, however, freeboard is increased without adding additional concrete by extending the flotation core beyond the bottom of the flotation container 36. The depth of the side walls and end walls will therefore be determined by that which is required for structural capacity and protection of the flotation core.

Since the weight of a float section of the present invention is not so limited by freeboard considerations as in prior art float sections, the thickness of the concrete sections comprising the shell may be increased for added strength and durability. As mentioned above, side flanges and end flanges of a thickness sufficient to permit direct attachment of mooring accessories and dock hinges may be added to a float section of the present invention. This is a significant advantage because the weight added by structural flanges had prevented their use in conventional monolithic floats. In addition, the durability of the concrete shell is improved because the increased concrete coverage of the embedded steel reinforcing reduces the susceptibility of corrosion and because the thicker concrete shell is less vulnerable to freeze-thaw deterioration. Furthermore, because the float sections do not rely on wooden wales for structural support, the structural integrity of the dock assembly does not deteriorate over time due to the shrinkage and fatigue of wood.

The special shape of the float sections increases efficiency of transportation and assembly of the dock assembly. Because float sections are stacked on top of one another during shipping, mooring accessories, such as cleats and bullrails, can only be installed on prior art float sections when they are unloaded at their final destination. In the present invention, however, the side and end flanges 54, 56 define a surface area that is larger than the surface area defined by the bottom portion 39 of the flotation core 38. Thus, when float sections are stacked on top of each other, the side and end flanges 54, 56 of one float section encompass the area in which the flotation core 38 of another float section rests. Consequently, mooring accessories mounted to the side and end flanges will not prevent the stacking of float sections and therefore can be installed prior to shipping. Moreover, since mooring accessories are allowed to develop their full rated capacity, pre-installed mooring cleats may be used to lift the float sections.

Finally, another advantage is realized by the lifting slots 78, which obviate the need to provide clear space between the top of one float section and the bottom of another to make room for the forks of a forklift. Elimination of the clear space between stacked floats allows more floats to be stacked on top of one another, which reduces transportation costs. A one inch thick sheet of compressible foam padding between stacked float sections is sufficient to protect them from damaging each other.

The present invention has been shown in the described embodiments for illustrative purposes only. The present invention may be subject to many modifications and changes without departing from the spirit or essential characteristics thereof. We therefore claim as our invention all such modifications as come within the spirit and scope of the following claims.

What is claimed is:

1. A float section for a floating dock assembly comprising:

a concrete shell having a top deck portion with an upper surface defining a walkway, a pair of opposing, longitudinally extending side walls, and a pair of opposing, transverse end walls, and an open bottom which together define a flotation container for receiving a flotation core; and at least one horizontally projecting concrete structural side flange integral with and extending along a length of a side wall, said flange having an upper surface that is planar to the upper surface of the deck portion.

2. The float section of claim 1, which further comprises a flotation core disposed in the flotation container which has a bottom end portion that extends outside of the flotation container.

3. The float section of claim 2 wherein the bottom end portion has a pair of longitudinally extending ridges, each of which overlaps the bottom end of one of said side walls and has a vertically extending surface portion that is aligned with the outside surface of said side wall.

4. The float section of claim 2 wherein the bottom end portion has a pair of transverse ridges, each of which overlaps the bottom end of one of said end walls and has a vertically extending surface portion that is aligned with the outside surface of said end wall.

5. The float section of claim 1 which further comprises a mooring accessory having a mounting portion secured to one of said side flanges.

6. The float section of claim 5 which further comprises a plurality of bolts extending vertically through the mounting portion and the flange securing the mooring accessory, thereby allowing the mooring accessory to develop its full rated capacity.

7. The float section of claim 6 wherein the mooring accessory is a mooring cleat.

8. The float section of claim 6 wherein the mooring accessory is a pile hoop.

9. A float section for a floating dock assembly comprising:

a concrete shell having a top deck portion with an upper surface defining a walkway, a pair of opposing, longitudinally extending side walls, and a pair of opposing, transverse end walls, and an open bottom which together define a flotation container for receiving a flotation core; and at least one horizontally projecting concrete structural end flange integral with and extending along a length of an end wall, each flange having an upper surface that is planar to the upper surface of the deck portion.

10. The float section of claim 9 which further comprises a flotation core disposed in the flotation container which has a bottom end portion that extends outside of the flotation container.

11. The float section of claim 10 wherein the bottom end portion has a pair of longitudinally extending ridges, each of which overlaps the bottom end of one of said side walls and has a vertically extending surface portion that is aligned with the outside surface of said side wall.

12. The float section of claim 10 wherein the bottom end portion has a pair of transverse ridges, each of which overlaps the bottom end of one of said end walls and has a vertically extending surface portion that is aligned with the outside surface of said end wall.

13. The float section of claim 9 which further comprises a mooring accessory having a mounting portion secured to one of said end flanges.

14. The float section of claim 13 which further comprises a plurality of bolts extending vertically through the mounting portion and the flange securing the mooring accessory, thereby allowing the mooring accessory to develop its full rated capacity.

15. The float section of claim 13 wherein the mooring accessory is a mooring cleat.

16. The float section of claim 13 wherein the mooring accessory is a pile hoop.

17. A float section for a floating dock assembly comprising:

a concrete shell having a top deck portion with an upper surface defining a walkway, a pair of opposing, longitudinally extending side walls, and a pair of opposing, transverse end walls, and an open bottom which together define a flotation container for receiving a flotation core; and a flotation core disposed in the flotation container and having a bottom portion extending outside the flotation container, the bottom portion overlapping a portion of a bottom ledge of at least one of said side walls or one of said end walls.

18. The float section of claim 17 wherein the bottom portion includes a pair of longitudinally extending ridges, each of which overlaps the bottom end of one of said side walls and has a vertically extending surface portion that is aligned with the outside surface of said side wall.

19. The float section of claim 17 wherein the bottom portion includes a pair of transverse ridges, each of which overlaps the bottom end of one of said end walls and has a vertically extending surface portion that is aligned with the outside surface of said end wall.

20. The float section of claim 17 which further comprises a plurality of transverse lifting slots defined in the bottom portion of the flotation core to permit lifting of the float section without damaging the flotation core.

21. A floating dock assembly comprising:

a pair of concrete dock sections, each having a top deck portion with an upper surface defining a walkway, a pair of opposing, longitudinally extending side walls, and a pair of opposing, transverse end walls;

said concrete dock sections positioned end-to-end, the adjacent end walls of said sections each having a horizontally projecting concrete structural flange integral with and extending along a length of the end wall; and a hinge assembly interconnecting said flanges comprising at least one layer of energy-absorbing, semi-flexible material having two ends, each of which is securely mounted to the bottom surface of one of said flanges.

22. The dock assembly of claim 21 wherein the hinge assembly comprises two layers of energy-absorbing, semi-flexible material.

23. The dock assembly of claim 21 wherein the hinge assembly further comprises a plurality of bolts that extend vertically through each flange and the corresponding end of said semi-flexible material.

24. A floating dock assembly comprising:

a pair of concrete dock sections, each having a top deck portion with an upper surface defining a walkway, a pair of opposing, longitudinally extending side walls, and a pair of opposing, transverse end walls;

said concrete dock sections positioned perpendicularly to one another, the adjacent walls of said sections each having a horizontally projecting concrete structural flange integral with and extending along a length of wall; and a hinge assembly interconnecting said flanges comprising at least one layer of energy-absorbing, semi-flexible material having two ends, each of which is securely mounted to the bottom surface of one of said flanges.

25. The dock assembly of claim 24 wherein the hinge assembly comprises two layers of energy-absorbing, semi-flexible material.

26. The dock assembly of claim 24 wherein the hinge assembly further comprises a plurality of bolts that extend vertically through each flange and the corresponding end of said semi-flexible material.

27. A monolithic float section comprising:

a concrete shell having a top deck portion with an upper surface defining a walkway, a pair of opposing, longitudinally extending side walls, and a pair of opposing, transverse end walls; and at least one horizontally projecting concrete structural side flange integral with and extending along a length of a side wall.

28. The float section of claim 27 wherein the length of the float section is over 12 feet.

29. The float section of claim 27 which further comprises a mooring accessory mounted on the side flange and plurality of bolts extending vertically through the mooring accessory and the side flange to secure the mooring accessory to the side flange and whereby the mooring accessory is able to develop its full rated capacity.

30. A monolithic float section comprising:

a concrete shell having a top deck portion with an upper surface defining a walkway, a pair of opposing, longitudinally extending side walls, and a pair of opposing, transverse end walls; and at least one horizontally projecting concrete structural end flange integral with and extending along a length of an end wall.

31. The float section of claim 30 wherein the length of the float section is over 12 feet.

32. The float section of claim 30 which further comprises a mooring accessory mounted on the end flange and plurality of bolts extending vertically through the mooring accessory and the end flange to secure the mooring accessory to the end flange and whereby the mooring accessory is able to develop its full rated capacity.

33. A float section for a floating dock assembly comprising:

a substantially rectangular concrete shell having a top deck portion with an upper surface defining a walkway, a pair of opposing, longitudinally extending side walls, and a pair of opposing, transverse end walls, and an open bottom which together define a flotation container for receiving a flotation core;

a pair of opposing, horizontally projecting concrete structural side flanges integral with and extending along a length of each side wall, each side flange having an upper surface that is planar to the upper surface of the deck portion;

a pair of opposing, horizontally projecting concrete structural end flanges integral with and extending along a length of each end wall, each end flange having an upper surface that is planar to the upper surface of the deck portion; and a flotation core disposed in the flotation container and having a bottom portion extending outside the flotation container, the bottom portion having a pair of longitudinally extending ridges, each of which overlaps the bottom end of one of said side walls and has a vertically extending surface portion that is aligned with the outside surface of said side wall, the bottom portion also having a pair of transverse ridges, each of which overlaps the bottom end of one of said end walls and has a vertically extending surface portion that is aligned with the outside surface of said end wall.

34. A concrete float section formed by a method comprising:

preparing a formwork having the desired shape and size of the float section;

placing a flotation core into the formwork, each side of the flotation core having a bottom edge portion that abuts against the inside surface of an adjacent formwork wall such that the flotation core is prevented from shifting laterally;

pouring concrete into the formwork around the sides and top of the flotation core to form a concrete shell; and removing the formwork from the float section.

35. The float section of claim 34, wherein the method of forming the float section further comprises installing steel reinforcing bars inside the formwork prior to pouring the concrete.

* * * * *